US011326305B2

(12) United States Patent
Miyazawa

(10) Patent No.: US 11,326,305 B2
(45) Date of Patent: May 10, 2022

(54) FIBROUS BODY ACCUMULATING DEVICE AND FIBER STRUCTURE PRODUCING DEVICE

(71) Applicant: SEIKO EPSON CORPORATION, Tokyo (JP)

(72) Inventor: Kazuma Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/168,386

(22) Filed: Feb. 5, 2021

(65) Prior Publication Data

US 2021/0246611 A1 Aug. 12, 2021

(30) Foreign Application Priority Data

Feb. 7, 2020 (JP) ..... JP2020-020035

(51) Int. Cl.
*D21F 1/02* (2006.01)

(52) U.S. Cl.
CPC ..... *D21F 1/026* (2013.01)

(58) Field of Classification Search
CPC ... D21F 1/026; D21F 1/02; D21F 9/02; D21F 9/00; D21G 9/0027; D21B 1/32; D04H 1/26
See application file for complete search history.

(56) References Cited

U.S. PATENT DOCUMENTS

| | | | | |
|---|---|---|---|---|
| 9,476,161 | B2 | 10/2016 | Higuchi et al. | |
| 9,776,213 | B2 * | 10/2017 | Miyazawa | D21F 9/00 |
| 2015/0176204 | A1 | 6/2015 | Miyazawa | |
| 2015/0275430 | A1 * | 10/2015 | Higuchi | D21F 9/04 162/261 |
| 2016/0222585 | A1 * | 8/2016 | Menke | D21C 5/02 |

FOREIGN PATENT DOCUMENTS

| | | | |
|---|---|---|---|
| JP | 2004-292959 | A | 10/2004 |
| JP | 2015-183336 | A | 10/2015 |

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

A fibrous body accumulating device includes: a drum having an opening for releasing a material containing fibers and rotating around a central axis; and a first dispersion member disposed in the drum and at a position unevenly distributed vertically below the central axis, and dispersing the material in the drum. Preferably, the fibrous body accumulating device further includes a second dispersion member disposed in the drum and at a position unevenly distributed vertically above the central axis, and dispersing the material in the drum.

6 Claims, 5 Drawing Sheets

FIBROUS BODY ACCUMULATING DEVICE AND FIBER STRUCTURE PRODUCING DEVICE

The present application is based on, and claims priority from JP Application Serial Number 2020-020035, filed Feb. 7, 2020, the disclosure of which is hereby incorporated by reference herein in its entirety.

BACKGROUND

1. Technical Field

The present disclosure relates to a fibrous body accumulating device and a fiber structure producing device.

2. Related Art

In recent years, a dry sheet manufacturing apparatus without using water as possible has been proposed. In the sheet manufacturing apparatus, for example, a method of pressurizing accumulations formed by an accumulating device that releases and accumulates fibrous bodies to manufacture a sheet has been known. Examples of the accumulating device include those having a configuration disclosed in JP-A-2004-292959.

The accumulating device disclosed in JP-A-2004-292959 includes a rotating drum having ejection holes, and a supply section supplying fibers into the drum. As the drum rotates, the fibers in the drum are released from the ejection holes and accumulated downward.

However, in the accumulating device of JP-A-2004-292959, the fibers are insufficiently loosened in the drum, such that lumps or aggregates of the fibers may be generated. In this case, an unevenness in the fibers released from each ejection hole is generated. As a result, a large amount of lumps are mixed in the accumulation, a thickness of the accumulation becomes uneven, and the quality of the accumulation deteriorates.

SUMMARY

According to an aspect of the present disclosure, a fibrous body accumulating device includes: a drum having an opening for releasing a material containing fibers and rotating around a central axis; and a first dispersion member disposed in the drum and at a position unevenly distributed vertically below the central axis, and dispersing the material in the drum.

According to another aspect of the present disclosure, a fiber structure producing device includes: the fibrous body accumulating device of the present disclosure; and a molding section molding an accumulation formed by the fibrous body accumulating device.

DESCRIPTION OF EXEMPLARY EMBODIMENTS

Hereinafter, a fibrous body accumulating device and a fiber structure producing device of the present disclosure will be described in detail based on preferred embodiments shown in the accompanying drawings.

First Embodiment

Figure 1:
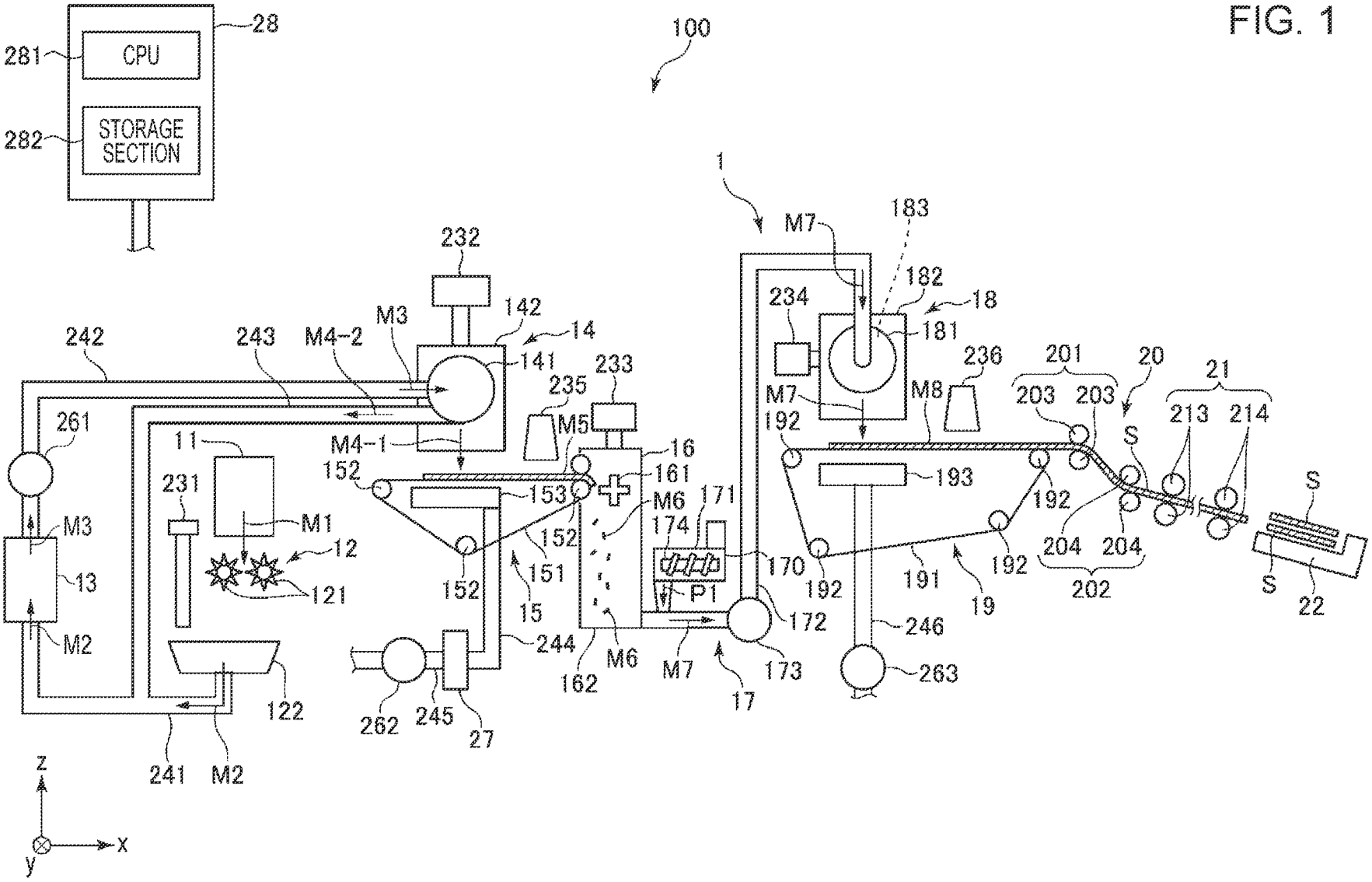
FIG. 1 is a schematic side view illustrating a fiber structure producing device including a fibrous body accumulating device according to a first embodiment.
Figure 2:
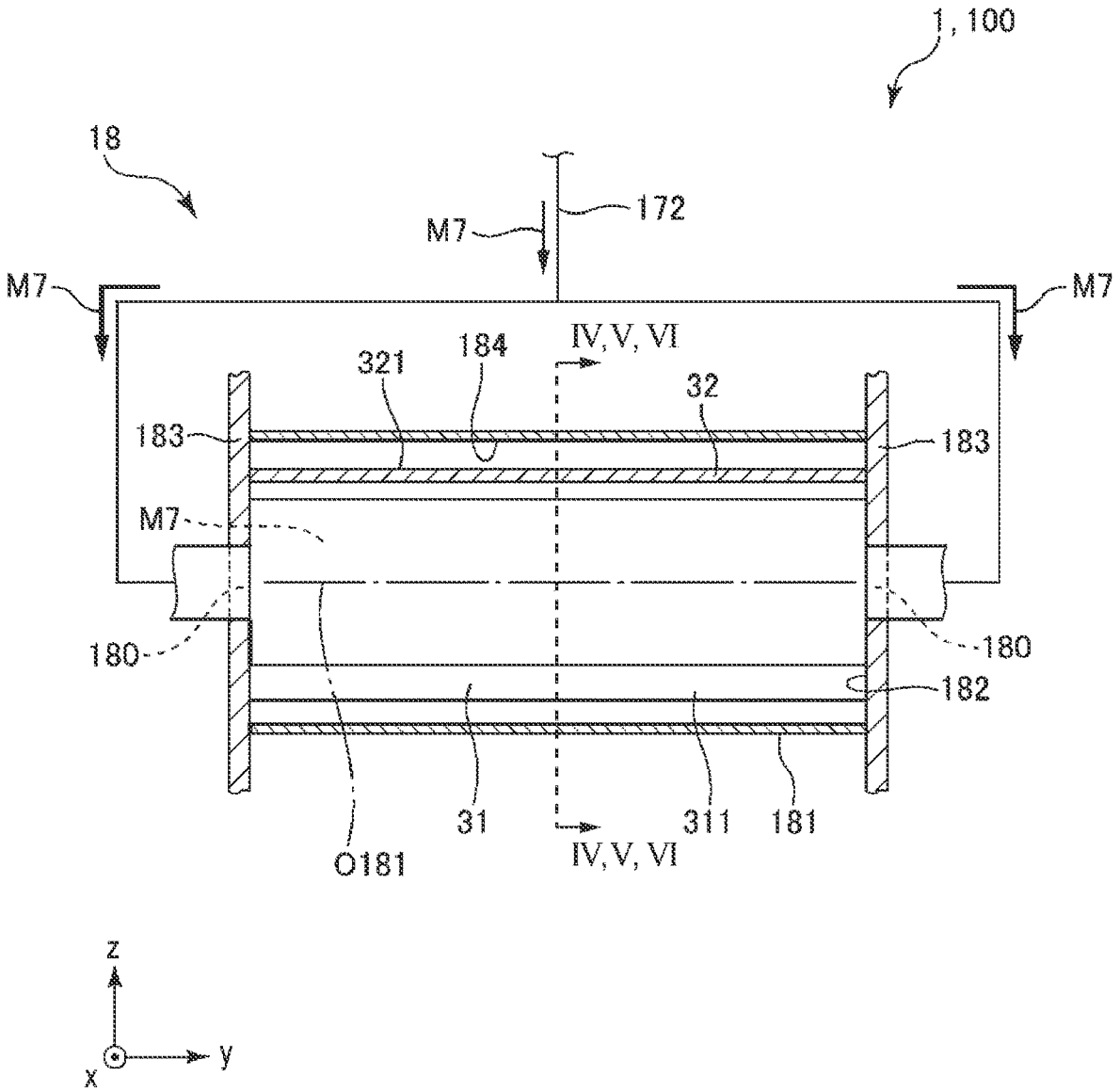
FIG. 2 is a longitudinal sectional view of a drum included in the fibrous body accumulating device illustrated in FIG. 1.
Figure 3:
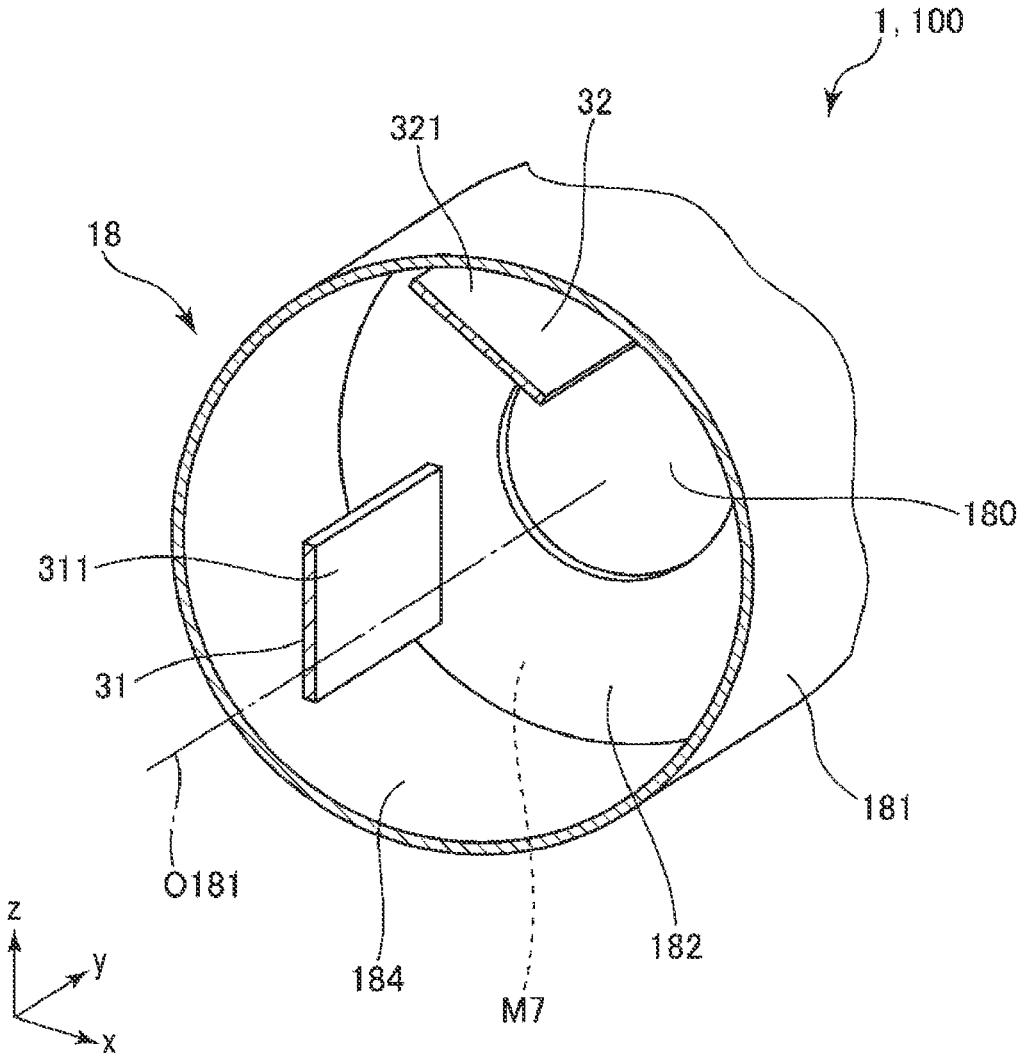
FIG. 3 is a perspective view of the drum illustrated in FIG. 2.
Figure 4:
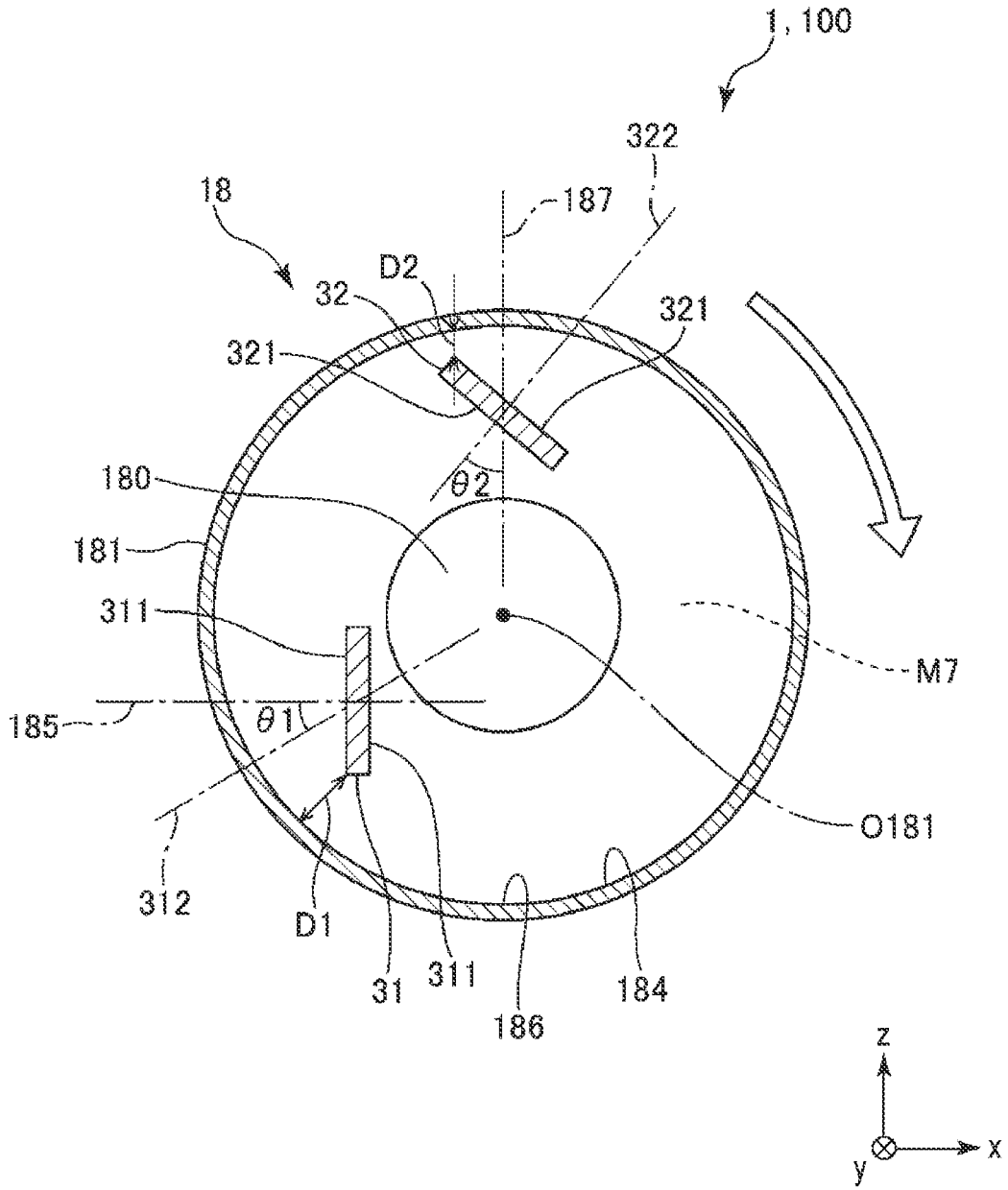
FIG. 4 is a cross-sectional view taken along line IV-IV in FIG. 2.
Figure 5:
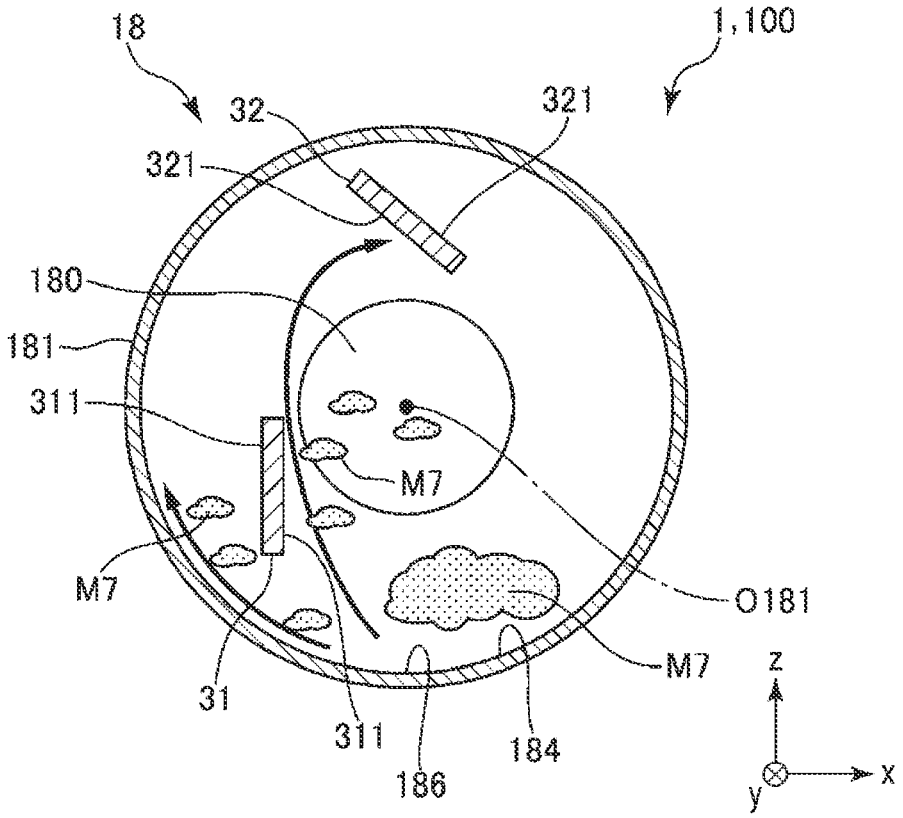
FIG. 5 is a cross-sectional view taken along line V-V in FIG. 2, and is a view illustrating a state in which materials are loosened.
Figure 6:
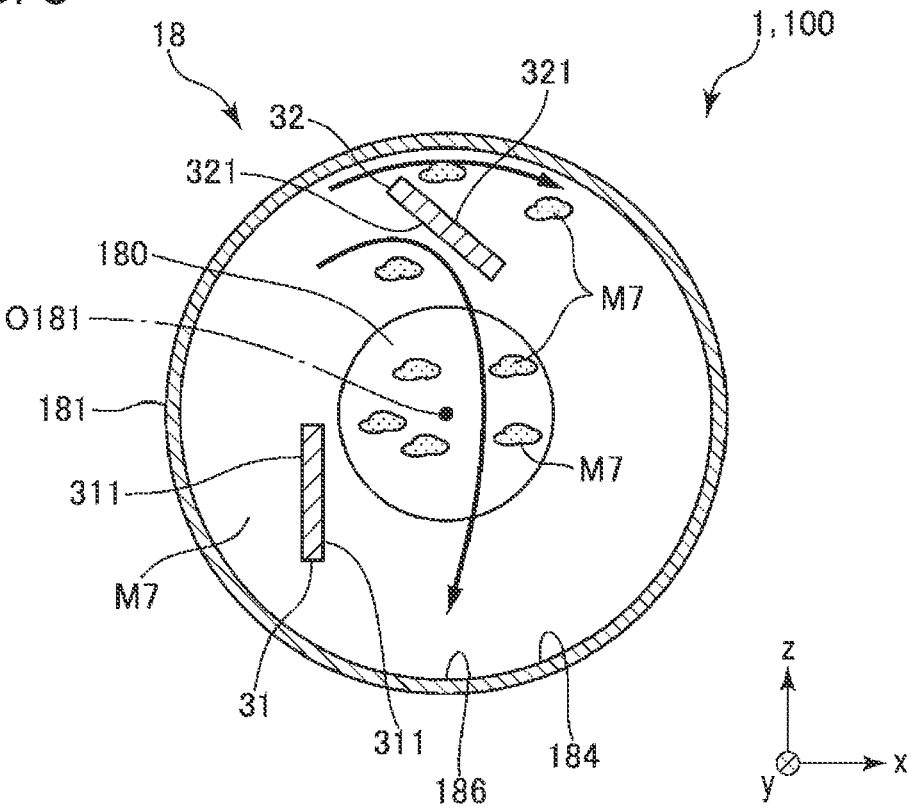
FIG. 6 is a cross-sectional view taken along line VI-VI in FIG. 2, and is a view illustrating a state in which materials are loosened.

FIG. 1 is a schematic side view illustrating a fiber structure producing device including a fibrous body accumulating device according to a first embodiment. FIG. 2 is a longitudinal sectional view of a drum included in the fibrous body accumulating device illustrated in FIG. 1. FIG. 3 is a perspective view of the drum illustrated in FIG. 2. FIG. 4 is a cross-sectional view taken along line IV-IV in FIG. 2. FIGS. 5 and 6 are cross-sectional views taken along lines V-V and VI-VI in FIG. 2, and are views illustrating a state in which materials are loosened.

In the following, for convenience of explanation, as illustrated in FIGS. 1 to 6, three axes orthogonal to each other are referred to as an x axis, a y axis, and a z axis. The xy plane including the x axis and the y axis is horizontal, and the z axis is vertical. The direction in which the arrow of each axis points is called "+", and the opposite direction is called "−". Also, the upper side of FIGS. 1 to 6 may be referred to as "upper" or "above", and the lower side may be referred to as "lower" or "below".

A fiber structure producing device 100 illustrated in FIG. 1 is a device for obtaining a molded body by crushing and defibrating a raw material M1, mixing a bonding material with the raw material M1, accumulating the mixture by a fibrous body accumulating device 1 to mold an accumulation thereof by a molding section 20.

The molded body produced by the fiber structure producing device 100 may be a sheet-like molded body such as recycled paper, or a block-shaped molded body. Further, a molded body having a density without limitation is used, but a molded body having a relatively high fiber density such as a sheet may be used, or a molded body having a relatively low fiber density such as a sponge body may be used, or a molded body in which these characteristics are mixed may be used.

Hereinafter, a molded body produced by using the raw material M1 as used or unnecessary used paper will be described as a sheet S which is recycled paper.

As illustrated in FIG. 1, the fiber structure producing device 100 includes a raw material supply section 11, a crushing section 12, a defibrating section 13, a sorting section 14, a first web forming section 15, a subdividing section 16, a mixing section 17, a dispersion section 18, a second web forming section 19, a molding section 20, a cutting section 21, a stock section 22, a collection section 27, and a control section 28 controlling these operations. Among these sections, the dispersion section 18 and the second web forming section 19 constitute the fibrous body accumulating device 1. The sections on upstream of the dispersion section 18, that is, the raw material supply section 11 to the mixing section 17 may be regarded as components of the fibrous body accumulating device 1.

The fiber structure producing device 100 includes a humidifying section 231, a humidifying section 232, a humidifying section 233, a humidifying section 234, a humidifying section 235, and a humidifying section 236. In addition, the fiber structure producing device 100 includes a blower 261, a blower 262, and a blower 263.

The humidifying sections 231 to 236 and the blowers 261 to 263 are electrically coupled to the control section 28, operations thereof are controlled by the control section 28. That is, in the present embodiment, a configuration in which the operation of each section in the fiber structure producing device 100 is controlled by one control section 28 is provided. However, the present disclosure is not limited to this, for example, a configuration of including a control section controlling an operation of each section in the fibrous body accumulating device 1 and a control section controlling the operations of portions other than in the fibrous body accumulating device 1 may be provided.

In the fiber structure producing device 100, a raw material supply process, a crushing process, a defibrating process, a sorting process, a first web forming process, a dividing process, a mixing process, a releasing process, an accumulating process, a sheet forming process, and a cutting process are performed in this order.

Hereinafter, the configuration of each section will be described.

The raw material supply section 11 is a portion that performs the raw material supply process of supplying the raw material M1 to the crushing section 12. The raw material M1 is a sheet-like material made of a fiber-containing material containing a cellulose fiber. The cellulose fiber may be any fibrous material containing cellulose as a main compound, and may contain hemicellulose and lignin in addition to cellulose. The form of the raw material M1 is not limited, such as woven fabric or non-woven fabric. The raw material M1 may be, for example, recycled paper recycled and manufactured by defibrating used paper, or synthetic YUPO paper (registered trademark), and may not be recycled paper.

The crushing section 12 is a portion that performs the crushing process of crushing the raw material M1 supplied from the raw material supply section 11 in the air such as the atmosphere. The crushing section 12 has a pair of crushing blades 121 and a chute 122.

The pair of crushing blades 121 rotate in the opposite direction to each other, such that the raw material M1 can be crushed, that is, cut between the pair of crushing blades 121 to obtain coarse debris M2. A shape and a size of the coarse debris M2 are preferably suitable for the defibrating process of the defibrating section 13. For example, a small piece having a side length of 100 mm or less is preferable, and a small piece having a side length of 10 mm or more and 70 mm or less is more preferable.

The chute 122 is disposed below the pair of crushing blades 121 and has, for example, a funnel shape. Therefore, the chute 122 can receive the coarse debris M2 crushed and fallen by the crushing blade 121.

The humidifying section 231 is disposed above the chute 122 so as to be adjacent to the pair of crushing blades 121. The humidifying section 231 humidifies the coarse debris M2 in the chute 122. The humidifying section 231 is configured of a vaporization type humidifier which has a filter containing moisture and supplies humidified air with increased humidity to the coarse debris M2 by passing air through the filter. By supplying the humidified air to the coarse debris M2, it is possible to suppress the coarse debris M2 from adhering to the chute 122 and the like due to static electricity.

The chute 122 is coupled to the defibrating section 13 via a pipe 241. The coarse debris M2 collected in the chute 122 passes through the pipe 241 and is transported to the defibrating section 13.

The defibrating section 13 is a portion that performs a defibrating process of defibrating the coarse debris M2 in the air, that is, in a dry method. By performing the defibrating process by the defibrating section 13, a defibrated material M3 can be generated from the coarse debris M2. Here, "defibrating" means unraveling the coarse debris M2 formed by binding a plurality of fibers into individual fibers. Then, the unraveled fibers become the defibrated material M3. The shape of the defibrated material M3 is linear or strip-shaped. Furthermore, the defibrated materials M3 may exist in a state in which they are intertwined into an aggregate, that is, in a state of forming a so-called "lump".

In the present embodiment, for example, the defibrating section 13 is configured of an impeller mill having a rotary blade that rotates at a high speed and a liner that is located on the outer periphery of the rotary blade. The coarse debris M2 flowed into the defibrating section 13 is defibrated while being interposed between the rotor and the liner.

The defibrating section 13 can generate a flow of air from the crushing section 12 toward the sorting section 14, that is, an airflow, by rotation of the rotary blade. Accordingly, the coarse debris M2 can be sucked into the defibrating section 13 from the pipe 241. After the defibrating process, the defibrated material M3 can be sent out to the sorting section 14 via a pipe 242.

The blower 261 is installed in the middle of the pipe 242. The blower 261 is an airflow generator that generates an airflow toward the sorting section 14. Accordingly, the sending out of the defibrated material M3 to the sorting section 14 is promoted.

The sorting section 14 is a portion that performs a sorting process of sorting the defibrated material M3 according to the length of the fibers. In the sorting section 14, the defibrated material M3 is sorted into a first sorted material M4-1 and a second sorted material M4-2 longer than the first sorted material M4-1. The first sorted material M4-1 has a size suitable for the subsequent manufacture of the sheet S. The average length of the first sorted material M4-1 is preferably 1 μm or more and 30 μm or less. On the other hand, the second sorted material M4-2 includes, for example, those in which fibers are insufficiently defibrated or those in which the defibrated fibers are excessively aggregated.

The sorting section 14 has a drum section 141 and a housing 142 that houses the drum section 141.

The drum section 141 is a sieve that is formed of a cylindrical net body and rotates about its central axis. The defibrated material M3 flows into the drum section 141. As the drum section 141 rotates, the defibrated material M3 smaller than a mesh opening of the net is sorted as the first sorted material M4-1, and the defibrated material M3 larger than the mesh opening of the net is sorted as the second sorted material M4-2.

The first sorted material M4-1 falls from the drum section 141.

On the other hand, the second sorted material M4-2 is sent out to a pipe 243 coupled to the drum section 141. The pipe 243 is coupled to the pipe 241 on the opposite side of the drum section 141, that is, on the upstream. The second sorted material M4-2 passed through the pipe 243 merges with the coarse debris M2 in the pipe 241 and flows into the defibrating section 13 with the coarse debris M2. As a result, the second sorted material M4-2 is returned to the defibrating section 13 and is subjected to the defibrating process with the coarse debris M2.

The first sorted material M4-1 that has fallen from the drum section 141 falls while being dispersed in the air and directs towards the first web forming section 15 located below the drum section 141. The first web forming section 15 is a portion that performs a first web forming process of forming a first web M5 from the first sorted material M4-1. The first web forming section 15 has a mesh belt 151, three stretching rollers 152, and a suction section 153.

The mesh belt 151 is an endless belt, and the first sorted material M4-1 is accumulated thereon. The mesh belt 151 is wound around the three stretching rollers 152. Then, the first sorted material M4-1 on the mesh belt 151 is transported downstream by the rotation of the stretching roller 152.

The first sorted material M4-1 has a size larger than the mesh opening of the mesh belt 151. As a result, the first sorted material M4-1 is restricted from passing through the mesh belt 151, and can thus be accumulated on the mesh belt 151. Further, the first sorted material M4-1 is transported downstream along with the mesh belt 151 while being accumulated on the mesh belt 151, and it is thus formed as a layered first web M5.

For example, dust and dirt may be mixed in the first sorted material M4-1. Dust and dirt may be generated due to crushing or defibration, for example. Such dust and dirt are collected in the collection section 27 to be described later.

The suction section 153 is a suction mechanism that sucks air from below the mesh belt 151. Accordingly, dust and dirt that has passed through the mesh belt 151 can be sucked together with air.

The suction section 153 is coupled to the collection section 27 via a pipe 244. The dust and dirt sucked by the suction section 153 are collected by the collection section 27.

A pipe 245 is further coupled to the collection section 27. Furthermore, the blower 262 is installed in the middle of the pipe 245. By the operation of the blower 262, a suction force can be generated in the suction section 153. As a result, the formation of the first web M5 on the mesh belt 151 is promoted. The first web M5 is one from which dust and dirt are removed. Furthermore, dust and dirt pass through the pipe 244 and reach the collection section 27 by the operation of the blower 262.

The housing 142 is coupled to the humidifying section 232. The humidifying section 232 is configured of a vaporization type humidifier. As a result, humidified air is supplied into the housing 142. The first sorted material M4-1 can be humidified by the humidified air, thereby suppressing the first sorted material M4-1 from adhering on an inner wall of the housing 142 by an electrostatic force.

The humidifying section 235 is disposed at the downstream of the sorting section 14. The humidifying section 235 is configured of an ultrasonic humidifier that sprays water. Accordingly, moisture can be supplied to the first web M5, thereby adjusting the moisture content of the first web M5. With this adjustment, it is possible to suppress adsorption of the first web M5 to the mesh belt 151 by the electrostatic force. As a result, the first web M5 is easily peeled off from the mesh belt 151 at a position where the mesh belt 151 is folded back by the stretching roller 152.

The subdividing section 16 is disposed at the downstream of the humidifying section 235. The subdividing section 16 is a portion that performs a dividing process of dividing the first web M5 peeled off from the mesh belt 151. The subdividing section 16 has a propeller 161 that is rotatably supported and a housing 162 that houses the propeller 161. The first web M5 can be divided by the rotating propeller 161. The divided first web M5 becomes a subdivided body M6. Furthermore, the subdivided body M6 descends in the housing 162.

The housing 162 is coupled to the humidifying section 233. The humidifying section 233 is configured of a vaporization type humidifier. As a result, humidified air is supplied into the housing 162. With the humidified air, it is possible to suppress the subdivided body M6 from adhering to the propeller 161 or an inner wall of the housing 162 by the electrostatic force.

The mixing section 17 is disposed at the downstream of the subdividing section 16. The mixing section 17 is a portion that performs a mixing process of mixing the subdivided body M6 and an additive. The mixing section 17 has an additive supply section 171, a pipe 172, and a blower 173.

The pipe 172 couples the housing 162 of the subdividing section 16 and a housing 182 of the dispersion section 18, and is a path through which a mixture M7 of the subdivided body M6 and the additive passes.

The additive supply section 171 is coupled in the middle of the pipe 172. The additive supply section 171 has a housing 170 in which the additive is stored, and a screw feeder 174 provided in the housing 170. The additive in the housing 170 is extruded from the housing 170 and supplied into the pipe 172 by the rotation of the screw feeder 174. The additive supplied into the pipe 172 is mixed with the subdivided body M6 to obtain the mixture M7.

Here, examples of the additive supplied from the additive supply section 171 can include a binder for binding fibers to each other, a coloring agent for coloring fibers, an aggregation inhibitor for inhibiting aggregation of fibers, a flame retardant for making fibers and the like difficult to burn, a paper strengthening agent for enhancing paper strength of the sheet S, a defibrated material, and the like. Among them, one or a plurality of additives can be used in combination. In the following, a case where the additive is a resin P1 as a binder will be described as an example. The additive includes a binder for binding fibers to each other, such that the strength of the sheet S can be enhanced.

As the resin P1, a powder resin or a particulate resin can be used. For example, as the resin P1, a thermoplastic resin, a curable resin, and the like can be used, but a thermoplastic resin is preferably used. Examples of thermoplastic resin include AS resin; ABS resin; polyolefin such as polyethylene, polypropylene, and ethylene-vinyl acetate copolymer; modified polyolefin; acrylic resin such as polymethyl methacrylate; polyester such as polyvinyl chloride, polystyrene, polyethylene terephthalate, and polybutylene terephthalate; polyamide such as nylon 6, nylon 46, nylon 66, nylon 610, nylon 612, nylon 11, nylon 12, nylon 6-12, and nylon 6-66; polyphenylene ether; polyacetal; polyether; polyphenylene oxide; polyether ether ketone; polycarbonate; polyphenylene sulfide; thermoplastic polyimide; polyether imide; liquid crystal polymer such as aromatic polyester; and various thermoplastic elastomers such as styrene-based elastomer, polyolefin-based elastomer, polyvinyl chloride-based elastomer, polyurethane-based elastomer, polyester-based elastomer, polyamide-based elastomer, polybutadiene-based elastomer, trans-polyisoprene-based elastomer, fluororubber-based elastomer, and chlorinated polyethylene-based elastomer. One or more of these materials selected therefrom may be used independently or in combination. As the thermoplastic resin, polyester or a resin containing these materials is preferably used.

In the middle of the pipe 172, the blower 173 is installed downstream of the additive supply section 171. Mixing of the subdivided body M6 and the resin P1 by an action of a rotation section such as a blade of the blower 173 is promoted. Furthermore, the blower 173 can generate airflow toward the dispersion section 18. With this airflow, the subdivided body M6 and the resin P1 can be stirred in the pipe 172. As a result, the mixture M7 can be transported into the dispersion section 18 in a state in which the subdivided body M6 and the resin P1 are uniformly dispersed. Furthermore, the subdivided body M6 in the mixture M7 is loosened during passing through the pipe 172 and becomes a finer fibrous.

As illustrated in FIG. 2, an end portion of the pipe 172 on the drum 181 side is branched into two forks, and the branched end portions are coupled to introduction ports 180 of the drum 181, respectively.

The dispersion section 18 illustrated in FIGS. 1 to 4 is a portion that performs a releasing process of loosening and releasing the mutually intertwined fibers in the mixture M7. The dispersion section 18 includes the drum 181 that introduces and releases the mixture M7 which is a defibrated material, the housing 182 that houses the drum 181, and a drive source 183 that rotates the drum 181.

The drum 181 is a sieve that is formed of a cylindrical net body and rotates about its central axis O181. The introduction ports 180 are formed on both end surfaces of the drum 181, and the branched end portions of the pipe 172 are coupled to the introduction ports 180, respectively. As a result, the mixture M7 is introduced into the drum 181 via the introduction port 180. Then, when the drum 181 rotates, fibers and the like smaller than the mesh opening of the net in the mixture M7 can pass through the drum 181. At that time, the mixture M7 is loosened and released. That is, the mesh of net of the drum 181 functions as an opening for releasing the material containing the fiber.

Although not illustrated, the drive source 183 includes a motor, a reduction gear, and a belt. The motor is electrically coupled to the control section 28 via a motor driver. A rotational force output from the motor is reduced by the reduction gear. The belt is configured of, for example, an endless belt, and is wound around an output shaft of the reduction gear and an outer circumference of the drum. As a result, the rotational force of the output shaft of the reduction gear is transmitted to the drum 181 via the belt.

The housing 182 is coupled to the humidifying section 234. The humidifying section 234 is configured of a vaporization type humidifier. As a result, humidified air is supplied into the housing 182. The humidified air can humidify the inside of the housing 182, and therefore, it is possible to suppress the mixture M7 from adhering to an inner wall of the housing 182 by the electrostatic force.

The mixture M7 released in the drum 181 falls while being dispersed in the air, and directs towards the second web forming section 19 located below the drum 181. The second web forming section 19 is a portion for performing an accumulation process of accumulating the mixture M7 to form a second web M8 which is an accumulation. The second web forming section 19 has a mesh belt 191, stretching rollers 192, and a suction section 193.

The mesh belt 191 is a mesh member, and in the configuration illustrated in FIG. 1, is configured of an endless belt. Further, the mixture M7 dispersed and released by the dispersion section 18 is accumulated on the mesh belt 191. The mesh belt 191 is wound around four stretching rollers 192. Then, the mixture M7 on the mesh belt 191 is transported downstream by the rotation of the stretching roller 192.

Most of the mixture M7 on the mesh belt 191 has a size larger than the mesh opening of the mesh belt 191. As a result, the mixture M7 can be restricted from passing through the mesh belt 191, thereby being accumulated on the mesh belt 191. Furthermore, the mixture M7 is transported downstream along with the mesh belt 191 while being accumulated on the mesh belt 191, and it is thus formed as a layered second web M8.

The suction section 193 is a suction mechanism that sucks air from below the mesh belt 191. Accordingly, the mixture M7 can be sucked on to the mesh belt 191, thereby promoting the mixture M7 being accumulated on the mesh belt 191.

A pipe 246 is coupled to the suction section 193. Furthermore, the blower 263 is installed in the middle of the pipe 246. By the operation of the blower 263, a suction force can be generated in the suction section 193.

The humidifying section 236 is disposed at the downstream of the dispersion section 18. The humidifying section 236 is configured of an ultrasonic humidifier similar to the humidifying section 235. As a result, moisture can be supplied to the second web M8, thereby adjusting the moisture content of the second web M8. With this adjustment, it is possible to suppress adsorption of the second web M8 to the mesh belt 191 by the electrostatic force. As a result, the second web M8 is easily peeled off from the mesh belt 191 at a position where the mesh belt 191 is folded back by the stretching roller 192.

The total content of the moisture added to the humidifying sections 231 to 236 is preferably 0.5 parts by mass or more and 20 parts by mass or less with respect to 100 parts by mass of the material before humidification, for example.

The molding section 20 is disposed at the downstream of the second web forming section 19. The molding section 20 is a portion that performs a sheet forming process of forming the sheet S from the second web M8. The molding section 20 has a pressurizing section 201 and a heating section 202.

The pressurizing section 201 has a pair of calender rollers 203 and can pressurize the second web M8 between the calender rollers 203 without heating. Accordingly, the density of the second web M8 is increased. When heating the second web M8, it is heated to some extent that the resin P1 is not melted, which is preferable. Then, the second web M8 is transported toward the heating section 202. One of the pair of calender rollers 203 is a main driving roller driven by the operation of a motor (not illustrated), and the other is a driven roller.

The heating section 202 has a pair of heating rollers 204 and can pressurize the second web M8 between the heating rollers 204 while heating the second web M8. By heating and pressurizing the second web M8, the resin P1 is melted in the second web M8, and fibers are bound to each other through the melted resin P1. As a result, the sheet S is formed. Then, the sheet S is transported toward the cutting section 21. One of the pair of heating rollers 204 is a main driving roller driven by the operation of a motor (not illustrated), and the other is a driven roller.

The cutting section 21 is disposed at the downstream of the molding section 20. The cutting section 21 is a portion that performs a cutting process of cutting the sheet S. The cutting section 21 has a first cutter 211 and a second cutter 212.

The first cutter 211 cuts the sheet S in a direction intersecting a transport direction of the sheet S, particularly, a direction orthogonal to the transport direction of the sheet S.

The second cutter 212 cuts the sheet S in a direction parallel to the transport direction of the sheet S at the downstream of the first cutter 211. This cutting is to remove unnecessary portions at both end portions of the sheet S, that is, end portions in +y axis direction and −y axis direction and to adjust the width of the sheet S. The cut and removed portion is called "edge".

By the cutting performed with the first cutter 211 and the second cutter 212, a sheet S having a desired shape and size can be obtained. The sheet S is further transported downstream and accumulated in the stock section 22.

The molding section 20 is not limited to a configuration of molding the accumulation on the sheet S as described above, and may be a configuration of molding the accumulation into, for example, a block-shaped or spherical molded body.

As described above, each section of the fiber structure producing device 100 is electrically coupled to the control section 28. The operation of each of these sections is controlled by the control section 28.

The control section 28 has a central processing unit (CPU) 281 and a storage section 282. The CPU 281 can execute various programs stored in the storage section 282, and can perform, for example, various determinations or various instructions.

For example, various programs such as a program for manufacturing a sheet S, various calibration curves, cables, and the like are stored in the storage section 282.

The control section 28 may be incorporated in the fiber structure producing device 100, or may be provided in an external device such as an external computer. For example, the external device may communicate with the fiber structure producing device 100 via a cable or the like or in a wireless manner, for example, the external device may be coupled to the fiber structure producing device 100 via the network such as the Internet.

The CPU 281 and the storage section 282 may be integrated into a single unit. The CPU 281 may be incorporated in the fiber structure producing device 100, and the storage section 282 may be provided in an external device such as an external computer. The storage section 282 may be incorporated in the fiber structure producing device 100, and the CPU 281 may be provided in an external device such as an external computer.

Meanwhile, as illustrated in FIGS. 2 and 3, the first dispersion member 31 and a second dispersion member 32 are provided in the drum 181 of the dispersion section 18. The first dispersion member 31 and the second dispersion member 32 stir and disperse the mixture M7 by colliding with the mixture M7 in the drum 181. As a result, it is possible to prevent or suppress the formation of lumps in the mixture M7 in the drum 181 and promote uniform release from the drum 181.

The first dispersion member 31 is disposed in the drum 181 and at a position unevenly distributed vertically below the central axis O181. When the center of gravity of the first dispersion member 31 is located vertically below the central axis O181, it is assumed that the first dispersion member 31 is disposed at a position unevenly distributed vertically below the central axis O181 even though a part of the first dispersion member 31 is located vertically above the central axis O181.

The first dispersion member 31 has an elongated shape extending along the central axis O181 of the drum 181, that is, along the y axis direction. The first dispersion member 31 has a plate shape having a pair of main surfaces 311 which are in a front-to-back relationship with each other.

As illustrated in FIG. 2, both end portions of the first dispersion member 31 are fixed and supported on side walls of the housing 182. Therefore, the first dispersion member 31 does not rotate with the rotation of the drum 181. That is, even when the drum 181 rotates, the first dispersion member 31 remains at an installation position. As a result, the mixture M7 that moves in the drum 181 with the rotation of the drum 181 can be reliably collided by the first dispersion member 31. Therefore, the mixture M7 can be loosened more effectively.

The first dispersion member 31 has an elongated shape extending along the central axis O181 of the drum 181. As a result, the first dispersion member 31 can satisfactorily disperse the mixture M7 over a wide range in the longitudinal direction of the drum 181.

Further, the first dispersion member 31 has a plate shape. That is, the first dispersion member 31 has a plate shape having a pair of main surfaces 311 which are in a front-to-back relationship with each other. The first dispersion member 31 is disposed to be separated from an inner peripheral surface 184 of the drum 181. As a result, the mixture M7 can pass between the first dispersion member 31 and the inner peripheral surface 184 of the drum 181. At that time, since the mixture M7 collides with an edge portion of the first dispersion member 31, the mixture M7 can be more effectively dispersed and stirred. As a result, the mixture M7 can be loosened more effectively.

As illustrated in FIG. 4, a separation distance D1, which is the shortest separation distance between the first dispersion member 31 and the inner peripheral surface 184 of the drum 181, is preferably 10 mm or more and 150 mm or less, and more preferably 20 mm or more and 100 mm or less. As a result, the mixture M7 can be loosened more effectively.

The first dispersion member 31 is provided such that a main surface 311 thereof is inclined with respect to a movement direction of the inner peripheral surface 184 of the drum 181. That is, the first dispersion member 31 has a plate shape, and a normal line 312 of the main surface 311 is installed so as to be inclined with respect to a straight line 185 along a radial direction of the drum 181. Note that, the normal line 312 is a straight line passing through the center of the main surface 311 and the straight line 185 is a straight line passing through the center of the first dispersion member 31. As a result, the mixture M7 can easily collide with the main surface 311. Therefore, the mixture M7 can be loosened more effectively.

As illustrated in FIG. 4, an angle θ1 formed by the normal line 312 and the straight line 185 is preferably 3° or more and 60° or less, and more preferably 10° or more and 40° or less. As a result, the mixture M7 can easily collide with the main surface 311. Therefore, the mixture M7 can be loosened more effectively.

The first dispersion member 31 is provided on a front side of a portion 186 that is most vertically downward in the drum 181 in a rotation direction of the drum 181. That is, as illustrated in FIG. 4, when the drum 181 rotates clockwise when viewed from the y axis direction, the first dispersion member 31 is located on a −x axis side of the central axis O181 of the drum 181 and on a −z axis side when viewed from a direction along the central axis O181 of the drum. As a result, the mixture M7 can be guided toward the second dispersion member 32 in a loosened state, which will be described later. When the drum 181 rotates counterclockwise when viewed from the y axis direction, the first dispersion member 31 is preferably located on the +x axis side of the central axis O181 of the drum 181 and on the −z axis side when viewed from a direction along the central axis O181 of the drum.

As described above, the fibrous body accumulating device 1 includes the first dispersion member 31 that is disposed at a position in the drum 181 unevenly distributed vertically below the central axis O181, and disperses the mixture M7 in the drum 181. Specifically, a portion of the first dispersion member 31 that is closest to the inner peripheral surface 184 of the drum 181 is located in the drum 181 and at a position unevenly distributed vertically below the central axis O181. As a result, the first dispersion member 31 collides with the mixture M7 at a position unevenly distributed vertically downward in the drum 181 where lumps are relatively likely to occur, and the mixture M7 is agitated and dispersed. Therefore, it is possible to effectively prevent or suppress the occurrence of lumps in the mixture M7 in the drum 181 and promote uniform discharge from the drum 181. As a result, a thickness of the second web M8 can be made uniform as possible, and the quality of the second web M8 can be improved.

Next, the second dispersion member 32 will be described.

As illustrated in FIGS. 2 to 4, the second dispersion member 32 is disposed in the drum 181 and at a position unevenly distributed vertically above the central axis O181 of the drum 181. The second dispersion member 32 has a function of stirring and dispersing the mixture M7 by colliding with the mixture M7 in the drum 181 and a function of guiding the mixture M7 in the drum 181 vertically downward to promote the release of the mixture M7.

As illustrated in FIGS. 2 and 3, the second dispersion member 32 has an elongated shape extending along the central axis O181 of the drum 181, that is, along the y axis direction. The second dispersion member 32 has a plate shape having a pair of main surfaces 321 which are in a front-to-back relationship with each other.

Further, both end portions of the second dispersion member 32 are fixed and supported on the side walls of the housing 182. Therefore, the second dispersion member 32 does not rotate with the rotation of the drum 181. That is, even when the drum 181 rotates, the second dispersion member 32 remains at an installation position. As a result, the mixture M7 that moves in the drum 181 with the rotation of the drum 181 can reliably collide by the second dispersion member 32. Therefore, the mixture M7 can be loosened more effectively, and the mixture M7 can be guided vertically downward in the drum 181.

The second dispersion member 32 has an elongated shape extending along the central axis O181 of the drum 181. As a result, the second dispersion member 32 can satisfactorily disperse the mixture M7 over a wide range in a longitudinal direction of the drum 181 and guide the mixture M7 vertically downward in the drum 181.

Further, the second dispersion member 32 has a plate shape. That is, the second dispersion member 32 has a plate shape having a pair of main surfaces 321 which are in a front-to-back relationship with each other. The second dispersion member 32 is disposed to be separated from an inner peripheral surface 184 of the drum 181. As a result, the mixture M7 can pass between the second dispersion member 32 and the inner peripheral surface 184 of the drum 181. At that time, since the mixture M7 collides with the edge of the second dispersion member 32, the mixture M7 can be more effectively dispersed and stirred. As a result, the mixture M7 can be loosened more effectively.

As illustrated in FIG. 4, the separation distance D2, which is the shortest separation distance between the second dispersion member 32 and the inner peripheral surface 184 of the drum 181, is preferably smaller than the separation distance D1. As a result, the second dispersion member 32 can effectively guide the mixture M7 vertically downward in the drum 181.

As described above, the first dispersion member 31 and the second dispersion member 32 are disposed apart from the inner peripheral surface 184 of the drum 181. Further, D1>D2, where the separation distance between the first dispersion member 31 and the inner peripheral surface 184 of the drum 181 is D1 and the separation distance between the second dispersion member 32 and the inner peripheral surface 184 of the drum 181 is D2. As a result, the second dispersion member 32 can effectively guide the mixture M7 vertically downward in the drum 181.

The separation distance D2 is not particularly limited, but is preferably 15 mm or more and 200 mm or less, and more preferably 25 mm or more and 120 mm or less. As a result, the second dispersion member 32 can effectively guide the mixture M7 vertically downward in the drum 181.

The second dispersion member 32 is provided such that the main surface 321 is inclined with respect to a movement direction of the inner peripheral surface 184 of the drum 181. That is, the second dispersion member 32 has a plate shape, and a normal line 322 of the main surface 321 is installed so as to be inclined with respect to a straight line 187 along a radial direction of the drum 181. Note that, the normal line 322 is a straight line passing through the center of the main surface 321 and the straight line 187 is a straight line passing through the center of second dispersion member 32. As a result, the mixture M7 can easily collide with the main surface 311. Therefore, the mixture M7 can be loosened more effectively, and the mixture M7 can be effectively guided vertically downward in the drum 181.

An angle θ2 formed by the normal line 322 and the straight line 187 is preferably smaller than the angle θ1 described above. As a result, the main surface 321 of the second dispersion member 32 on the vertically downward side faces vertically downward, and the mixture M7 can be more effectively guided to the vertically downward side in the drum 181.

The angle θ2 is preferably 2° or more and 55° or less, and more preferably 5° or more and 35° or less. As a result, the mixture M7 can be more effectively guided to the vertically downward side in the drum 181.

As described above, the fibrous body accumulating device 1 includes the second dispersion member 32 that is disposed in the drum 181 and at a position unevenly distributed vertically above the central axis O181, and disperses the mixture M7, which is a material in the drum 181. As a result, the mixture M7 can be more effectively stirred and dispersed by the synergistic effect with the first dispersion member 31, and the mixture M7 in the drum 181 is guided vertically downward to promote the release of the mixture M7.

Specifically, as illustrated in FIG. 5, even if a lump of the mixture M7 is formed, a part of the lump passes between the first dispersion member 31 and the inner peripheral surface 184 of the drum 181. The rest is stirred and dispersed by the main surface 311 of the first dispersion member 31. Then, as illustrated in FIG. 6, a part of these passes between the second dispersion member 32 and the inner peripheral surface 184 of the drum 181 and is further finely stirred and dispersed, and the rest is the second dispersion member 32.

It is further finely stirred and dispersed by the main surface 321 of the above. Then, the finely stirred and dispersed mixture M7 is guided vertically downward in the drum 181. As such, since the mixture M7 is guided vertically downward in the drum 181 in a state where the lumps are loosened, more uniform release of the mixture M7 can be realized. As a result, a thickness of the second web M8 can be made uniform as possible, and the quality of the second web M8 can be improved.

As described above, the fibrous body accumulating device 1 includes a drum 181 having an opening for releasing the mixture M7 which is a material containing fibers and rotating around the central axis O181, and the first dispersion member 31 disposed in the drum 181 and at a position unevenly distributed vertically below the central axis O181, and dispersing the mixture M7 in the drum 181. As a result, the first dispersion member 31 collides with the mixture M7 at a position unevenly distributed vertically downward in the drum 181 where lumps are relatively likely to occur, and the mixture M7 is agitated and dispersed. Therefore, it is possible to prevent or suppress the formation of lumps in the mixture M7 in the drum 181 and promote uniform release from the drum 181. As a result, it is possible to reduce the lumps mixed in the second web M8, make a thickness of the second web M8 uniform as possible, and improve the quality of the second web M8.

The fiber structure producing device 100 includes the above-described fibrous body accumulating device 1 and a molding section 20 molding the mixture M7 which is an accumulation formed by the fibrous body accumulating device 1. By molding the high quality second web M8 formed by the fibrous body accumulating device 1, a high quality sheet S, that is, a fiber structure can be obtained.

The configuration in which the both end portions of the first dispersion member 31 and the second dispersion member 32 are fixed and supported on the side walls of the housing 182 has been described, but the present disclosure is not limited to this, and one end portions of the first dispersion member 31 and the second dispersion member 32 may be fixed and supported on the side walls of the housing 182.

Further, the configuration in which the first dispersion member 31 and the second dispersion member 32 have a plate shape has been described, but the present disclosure is not limited to this, and may be any shape such as a rod shape or a comb-teeth shape.

The first dispersion member 31 and the second dispersion member 32 may have protrusions provided to be separated from each other along the longitudinal direction. The first dispersion member may be a member having rods disposed in a grid pattern. With these configurations, a surface area can be increased as possible, thereby increasing chances to collide with the mixture M7. Therefore, the first dispersion member has an excellent dispersion function.

Further, a plurality of first dispersion members 31 may be disposed to be displaced in a circumferential direction of the drum 181.

As described above, the fibrous body accumulating device and the fiber structure producing device of the present disclosure are described with respect to the illustrated embodiments. However, the present disclosure is not limited to this, and each portion which constitutes the fibrous body accumulating device and the fiber structure producing device can be replaced with any component that can exhibit the same function. Furthermore, any components may be added.

What is claimed is:

1. A fibrous body accumulating device, comprising:

a drum having an opening for releasing a material containing fibers, and the drum being configured to rotate about a central axis;

a first dispersion member disposed in the drum at a position vertically lower than a position of the central axis, and the first dispersion member being configured to disperse the material in the drum when the drum rotates, the first dispersion member being spaced apart from an inner peripheral surface of the drum such that a prescribed gap is formed between the inner peripheral surface of the drum and the first dispersion member; and a second dispersion member disposed in the drum and at a position vertically lower than a position of the central axis, and the second dispersion member being configured to disperse the material in the drum, wherein the first dispersion member and the second dispersion member are spaced apart from an inner peripheral surface of the drum, and D1>D2, where a separation distance between the first dispersion member and the inner peripheral surface of the drum is D1, and a separation distance between the second dispersion member and the inner peripheral surface of the drum is D2.

2. The fibrous body accumulating device according to claim 1, wherein the first dispersion member extends along the central axis.

3. The fibrous body accumulating device according to claim 1, wherein the first dispersion member has a plate shape, and a line normal to a main surface skewed with respect to the central axis.

4. The fibrous body accumulating device according to claim 1, wherein the first dispersion member is provided on a forward side with respect to a rotation direction of the drum than a lower most portion of the drum.

5. The fibrous body accumulating device according to claim 1, wherein the first dispersion member does not rotate with the drum.

6. A fibrous body accumulating device, comprising:

a drum having an opening for releasing a material containing fibers, and the drum being configured to rotate about a central axis;

a first dispersion member disposed in the drum at a position vertically lower than a position of the central axis, and the first dispersion member being configured to disperse the material in the drum when the drum rotates, the first dispersion member being spaced apart from an inner peripheral surface of the drum such that a prescribed gap is formed between the inner peripheral surface of the drum and the first dispersion member;

a second dispersion member disposed in the drum and at a position vertically lower than a position of the central axis, and the second dispersion member being configured to disperse the material in the drum, wherein the first dispersion member and the second dispersion member are spaced apart from an inner peripheral surface of the drum, and D1>D2, where a separation distance between the first dispersion member and the inner peripheral surface of the drum is D1, and a separation distance between the second dispersion member and the inner peripheral surface of the drum is D2; and a molding section molding an accumulation formed by the fibrous body accumulating device.

* * * * *